US007716791B2

(12) United States Patent
Färber et al.

(10) Patent No.: US 7,716,791 B2
(45) Date of Patent: May 18, 2010

(54) APPARATUS AT A SPINNING PREPARATION MACHINE, ESPECIALLY A FLAT CARD, ROLLER CARD OR THE LIKE, FOR ASCERTAINING CARDING PROCESS VARIABLES

(75) Inventors: Christoph Färber, Korchenbroich (DE); Achim Breuer, Aachen (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 389 days.

(21) Appl. No.: 11/802,357

(22) Filed: May 22, 2007

(65) Prior Publication Data

US 2007/0266528 A1 Nov. 22, 2007

(30) Foreign Application Priority Data

May 22, 2006 (DE) ..... 10 2006 024 132
Jan. 31, 2007 (DE) ..... 10 2007 005 601

(51) Int. Cl.
*D01G 15/12* (2006.01)

(52) U.S. Cl. ..... 19/98; 19/65 A

(58) Field of Classification Search ..... 19/65 A, 19/98

See application file for complete search history.

(56) References Cited

U.S. PATENT DOCUMENTS 5,040,272 A * 8/1991 Fritzsche ..... 19/104
5,398,381 A 3/1995 Schlichter et al.
6,317,931 B1 11/2001 Steinert

FOREIGN PATENT DOCUMENTS

| | | | |
|---|---|---|---|
| DE | 28 34 586 | A1 | 2/1980 |
| DE | 198 23 571 | A1 | 3/1999 |
| DE | 10323168 | A1 | 12/2004 |
| EP | 1 215 312 | A1 | 12/2001 |
| FR | 2877954 | A1 | 5/2006 |
| GB | 2 368 351 | A | 5/2002 |
| GB | 2 431 413 | A | 4/2007 |
| WO | WO 91/19841 | A1 | 12/1991 |

OTHER PUBLICATIONS

British Search Report, dated Sep. 18, 2007, issued on British Application No. GB0709631.6.
The German Search Report for Application No. 10 2006 024 132.0 (and Partial Translation).
French Preliminary Search Report, dated Dec. 17, 2009, issued in French Application No. 0757643, filed on Sep. 18, 2007 (with English Translation).

* cited by examiner

*Primary Examiner*—Shaun R Hurley
(74) *Attorney, Agent, or Firm*—Venable LLP; Robert Kinberg; Leigh D. Thelen

(57) ABSTRACT

In an apparatus at a spinning preparation machine, wherein a clothed roller is located opposite at least one clothed component, there is associated with the component, in contact therewith, a piezoelectric sensor which is connected to an electrical evaluation device in communication with a display device and/or switching device. In order, by simple means to make it possible to ascertain the carding intensity, the piezoelectric sensor is a structure-borne sound sensor and the electrical evaluation device is capable of determining the carding intensity from the structure-borne sound.

20 Claims, 7 Drawing Sheets

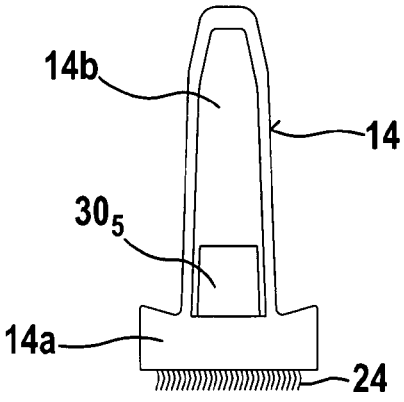
Fig.4
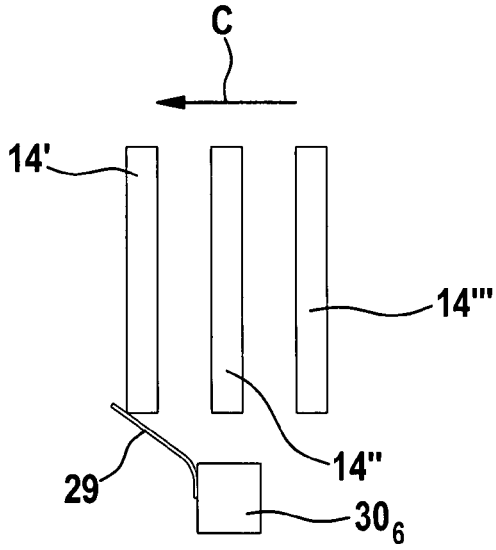
Fig.5
Fig.6
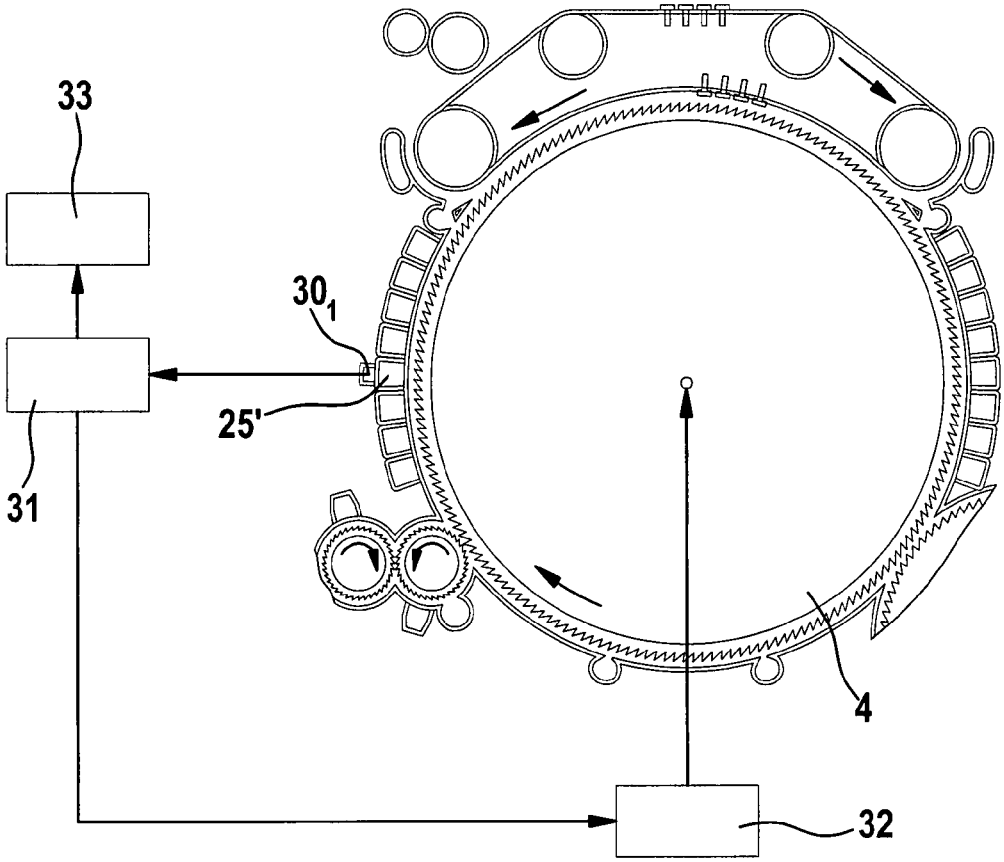

APPARATUS AT A SPINNING PREPARATION MACHINE, ESPECIALLY A FLAT CARD, ROLLER CARD OR THE LIKE, FOR ASCERTAINING CARDING PROCESS VARIABLES

CROSS REFERENCE TO RELATED APPLICATION

The present application claims priority from German Patent Application No. 10 2006 024 132.0 dated May 22, 2006, and German Patent of Application No. 10 2007 005 601.1 dated Jan. 31, 2007, the entire disclosure of which are incorporated herein by reference.

BACKGROUND TO THE INVENTION

The invention relates to an apparatus at a spinning preparation machine, especially a flat card, roller card or the like, for ascertaining carding process variables, wherein a clothed, rapidly rotating roller is located opposite at least one clothed component.

It is known to associate with the clothed component, in contact therewith, a piezoelectric sensor which is connected to an electrical evaluation device in communication with a display device and/or switching device. More particularly, from EP 1 215 312 A1 it is known, in the case of a revolving card top and a stationary carding segment, to measure the carding forces (shear forces) at both carding elements using a piezoelectric layer in each case. These piezoelectric layers are connected to a measurement apparatus. The measurement apparatus passes a corresponding signal to a control and regulation device. The carding forces are measured by means of piezoelectric layers and the associated measurement apparatuses and are passed to the control and regulation device by means of signals. In that arrangement, the carding force at the fixed carding element or at the revolving card top is determined by means of force measurement. It is disadvantageous that the carding forces, which are caused by the fibres between the tips, are minimal and the carding force sensors have a high weight owing to their freely movable carding elements. A further disadvantage lies in the fact that the mass inertia of such a system is very high. Accordingly, the resultant difference between the baseline signal and the useful signal is vanishingly small. If the weight of such a sensor is reduced, the rigidity of the system is reduced and sagging of the carding element is increased, whilst the measurement result is falsified because the spacing between the sensor and the roller changes. In the case of the known apparatus, the force sensor cuts through the lines of force, so that forces and shear forces can be detected. In the process, it is immaterial whether the piezo sensor detects the shear forces between the clothing and carding component holder or, for example, with respect to the side screen, because the lines of force pass through the entire structural unit. Because a force sensor cuts through lines of force, it must always rest against a component. For example, the clothing rests against the carding component, or the carding component rests against the side screen (corresponding force sensors between those components). Therefore it is not possible, in operation, to move a force sensor from one component to another component without changing settings, that is to say without undoing and re-fixing components, and interrupting lines of force. A constant force at the clothing produces a constant force at the piezo sensor and therefore a carding force produces no change in the piezo signal. Electrical filtering of the signal is not necessary because the forces from other machine regions do not influence the carding force measurement. Finally, the outlay for the measurement is, in terms of apparatus, high because the carding component has to be modified for the purpose of integrating the sensor.

The problem underlying the invention is accordingly to provide an apparatus of the kind described at the beginning that avoids the mentioned disadvantages and that especially makes it possible, by means that are simple in terms of construction, to ascertain the intensity of contact between fibres and the fibre-guiding clothing of the component (the carding intensity).

As a result of the fact that the piezoceramic sensor is a structure-borne sound sensor of high sensitivity, which is associated with a component and in contact therewith, it is possible to ascertain the carding intensity by means that are simple in terms of construction. The structure-borne sound sensor is merely coupled up to a component in which structure-borne sound vibrations occur, as a result of which those structure-borne sound vibrations also pass into and flow through the structure-borne sound sensor, and the vibrations can be detected by means of a measurement arrangement. If the structure-borne sound sensor and the fixed carding element are so constructed that, for example, their connection is, advantageously, magnetic in nature, the structure-borne sound sensor can, in the course of continuing production, be moved from carding element to carding element, being placed thereon, and the carding intensity can be measured. It is accordingly possible, within the shortest time, to investigate all the carding locations of a flat card, including the card top, with regard to the carding intensity thereof, in the course of continuing production. As a result of the fact that the structure-borne sound sensor, which is, for example, a small cuboid, is fixed in, for example, an existing fixed carding element or revolving card top, functions of the fixed carding element or revolving card top are in no way curtailed by a change in geometry etc.

In the course of carding, the fibres produce a transverse vibration in the clothing, which propagates through the entire carding component. If the piezo sensor is attached to a carding component through which vibrations pass, the vibration also runs through this mounted sensor. Consequently, the vibration also causes deformation of that component, that is to say the vibration can be described by means of the piezo sensor. Even in the case of a constant force at the clothing, a change in the piezo signal occurs. Electrical filtering of the signal is necessary because the vibrations from other machine regions influence the structure-borne sound measurement. Low-frequency vibrations of all moving components are filtered out. The apparatus is simple in terms of construction, as the piezo sensor merely has to be placed on the component.

The structure-borne sound sensor is advantageously of high sensitivity. Preferably, the sensitivity of the structure-borne sound sensor is about 10 V/N to 50 V/N, especially about 25 V/N to 35 V/N. The structure-borne sound sensor may be capable of detecting vibrations in the range from about 2.5 kHz to 12.5 kHz. In certain preferred embodiments, the evaluation device is capable of filtering out low-frequency vibrations, for example, is capable of filtering out frequencies outside the range of about 2.5 kHz to 12 kHz. One illustrative evaluation device has a frequency analysis function (Fourier analysis). A high-pass filter may be used. In certain preferred arrangements, carding is carried out between a clothing-carrying roller and a carding element, a piezoceramic structure-borne sound sensor being associated with one of the clothing-carrying components. The structure-borne sound sensor may, for example, be arranged directly on the rear side of the clothing. The structure-borne sound sensor may, for example, be fixed in the middle of the machine width. In some embodiments, the structure-borne sound sensor is fixed in a fixed carding segment. In other embodiments, the structure-borne sound sensor is fixed in a revolving card top. The structure-borne sound sensor may be fixed to the component by means of adhesion. Other suitable fixing methods include fixing by means of magnetic force, by means of a screw connection, or by means of a shape-based connection. In some embodiments, the structure-borne sound sensor is externally fixed on a component carrying a clothing strip. There may in some arrangements be a direct structure-borne sound line between clothing support and adapter plate, for example, by means of a screw connection. In certain embodiments, the structure-borne sound sensor is fixed on a plate which is flexibly associated with different clothing-strip-carrying components by means of a rapid closure. The rapid closure may be provided, for example, by means of a shape-based or force-based connection. It is advantageous for the structure-borne sound sensor signals to be so filtered that the signal contains no components of structure-borne sound vibrations of the spinning preparation machine that are caused by moving parts of the machine. For example, all structure-borne sound vibrations less than 2.5 kHz are filtered out from the structure-borne sound sensor signals. It is preferred that there are used solely those components of the structure-borne sound sensor signal that are caused by the fibre movement between the carding parts of the machine. The structure-borne sound sensor signals may be evaluated, for example, by means of statistical evaluation methods (mean, standard deviation, CV value). The structure-borne sound sensor signals may, for example, be integrated. The structure-borne sound sensor signals in their course over time and in the frequency range may, for example, be evaluated by means of statistical evaluation methods. The structure-borne sound sensor signals may, for example, be logarithmised to avoid over-valuation of signal peaks. In one embodiment, in the frequency range the structure-borne sound sensor signal curves "with fibre material" are deduced from those "without fibre material" and the course of the difference in the frequency range is evaluated.

The carding intensity "with fibre material" may be subtracted from "without fibre material". Instead, the carding intensity "with fibre material" may be divided by "without fibre material". Signal peaks in the course over time may be evaluated as thick places. The variables standard deviation and CV value represent a measure of the fibre unraveling. From the determined data, carding intensity classes (amplitude; frequency) are formed in order to be able to evaluate the pulses in detail. With fixed carding between two carding components there will be clearly associated at least one carding coefficient which reflects the carding intensity. On the basis of the carding intensity information at each carding component, the clothing wear can, for example, be assessed and the setting checked. The carding intensity of the machine as a whole can be determined by accumulation of individual measurements and can be set against a quality statement for the machine, for example, flat card. Illustrative of a quality statement for a flat card would be: 95 neps/g; 9.8% short fibres.

In certain embodiments there may be a multiplicity of carding elements and each carding element may have its own structure-borne sound sensor associated with it. In other embodiments, the structure-borne sound sensor is in the form of a portable unit which can be used on any machine. In yet further embodiments, the apparatus is so arranged that the operator can associate one and the same structure-borne sound sensor with each carding element in succession, in accordance with a fixed program sequence. The structure-borne sound sensor signals of more than two carding elements may be evaluated relative to one another. In some embodiments, the grading of the carding elements for example with respect to the number of ties, spacing, clothing condition, clothing type, can be assessed by means of the structure-borne sound sensor signal, by comparing the carding coefficients of all the carding elements with specifications relating to desirable grading of the carding intensity. Preferably, in the comparison of the carding coefficients of different carding elements the carding coefficients are normalisable. If desired, the structure-borne sound sensor can be used for analysis at fibre-guiding components, for example web guide, pressure bar, holding-down device, webspeed, funnel, cover plates at the transfers from rollers (drum-doffer).

In certain preferred arrangements, the machine is a flat card and the structure-borne sound sensor is associated with the revolving card top, is fixed in or on it and revolves with it. The structure-borne sound sensor may be fixed in a stationary position on the track of the revolving card top flats. Instead, there may be attached to the structure-borne sound sensor a structure-borne sound guide plate, for example, a spring steel plate, by means of which the structure-borne sound of the revolving card top flats is detected and conveyed to the structure-borne sound sensor. The structure-borne sound sensor may in some embodiments be directly or indirectly associated with a blade in order to quantify the waste separation, that is to say composition and amount. It is preferred that the apparatus includes a control system, the clothing condition, that is to say new or worn clothing, for example of a clothing strip, being determined using the structure-borne sound sensor, by means of the fact that the carding coefficient is determined and monitored by the control system and a warning being issued by the control system in the event of a limit value being exceeded. A portable structure-borne sound sensor unit with evaluation device may, in preferred embodiments, consist of, for example, a display for output of the carding coefficient, a start button for activation of the measurement and an LED for display of the operating situation.

In the case of revolving card flats, in one embodiment a first flat, having a clothing, carries the structure-borne sound sensor and a second flat, not having a clothing, having on-board electronics units, runs behind the first flat. The first flat is advantageously connected to the second flat by a sensor cable. Between the first flat (having a clothing) and the second flat (having electronics units) there may be arranged no flat or at least one flat having a clothing. The sensor may be associated with a holding element, for example, a clasp or the like, in contact with and touching at least two different wall surfaces of the carrier member. The clasp may be associated with the card flat by means of a shape-based or force-based connection. The clasp may be so associated with the card flat that the sensor is arranged inside the card flat or outside the card flat. The signals of the structure-borne sound sensor are advantageously recordable throughout its travel over the flexible bend. Instead, the signals of the structure-borne sound sensor can be recorded at particular places over the flexible bend, over a period of time. The signals can advantageously be recorded at each change of setting of the card flat. In preferred embodiments, a plurality of structure-borne sound sensors are attached by clasps to a card flat, preferably on both sides, that is, on the left and right sides of the machine. In one embodiment, a clasp and sensor are associated with a carding flat, and an electronics unit can also be arranged, for example, can be insertable, in the same flat in the form of an insert variant.

The invention also provides an apparatus at a spinning preparation machine, especially a flat card, roller card or the like, wherein a clothed, rapidly rotating roller is located opposite at least one clothed component, there being associated with the component, in contact therewith, a piezoelectric sensor which is connected to an electrical evaluation device in communication with a display device and/or switching device, wherein the piezoelectric sensor is a structure-borne sound sensor of high sensitivity and the electrical evaluation device is capable of determining from the structure-borne sound the intensity of contact between fibres and the fibre-guiding clothing of the component (the carding intensity).

BRIEF DESCRIPTION OF THE DRAWINGS

FIG. 3' shows a detail of FIG. 3 to an enlarged scale

FIG. 4 is a schematic side view of a flat for a revolving card top unit according to FIG. 2, in the internal space of which a structure-borne sound sensor is provided;

FIG. 5 is a plan view of a revolving card top with a stationary structure-borne sound sensor having a structure-borne sound guide plate, by means of which the structure-borne sound of the revolving card top is detected;

FIG. 6 is a diagrammatic side view of a carding cylinder with stationary carding elements and a revolving card top, and showing a generalised circuit diagram with an electrical control and regulation apparatus, to which there are connected a structure-borne sound sensor, a filter device, an evaluation device, an actuator for a drive motor and a display device;

DETAILED DESCRIPTION OF CERTAIN PREFERRED EMBODIMENTS

Figure 1:
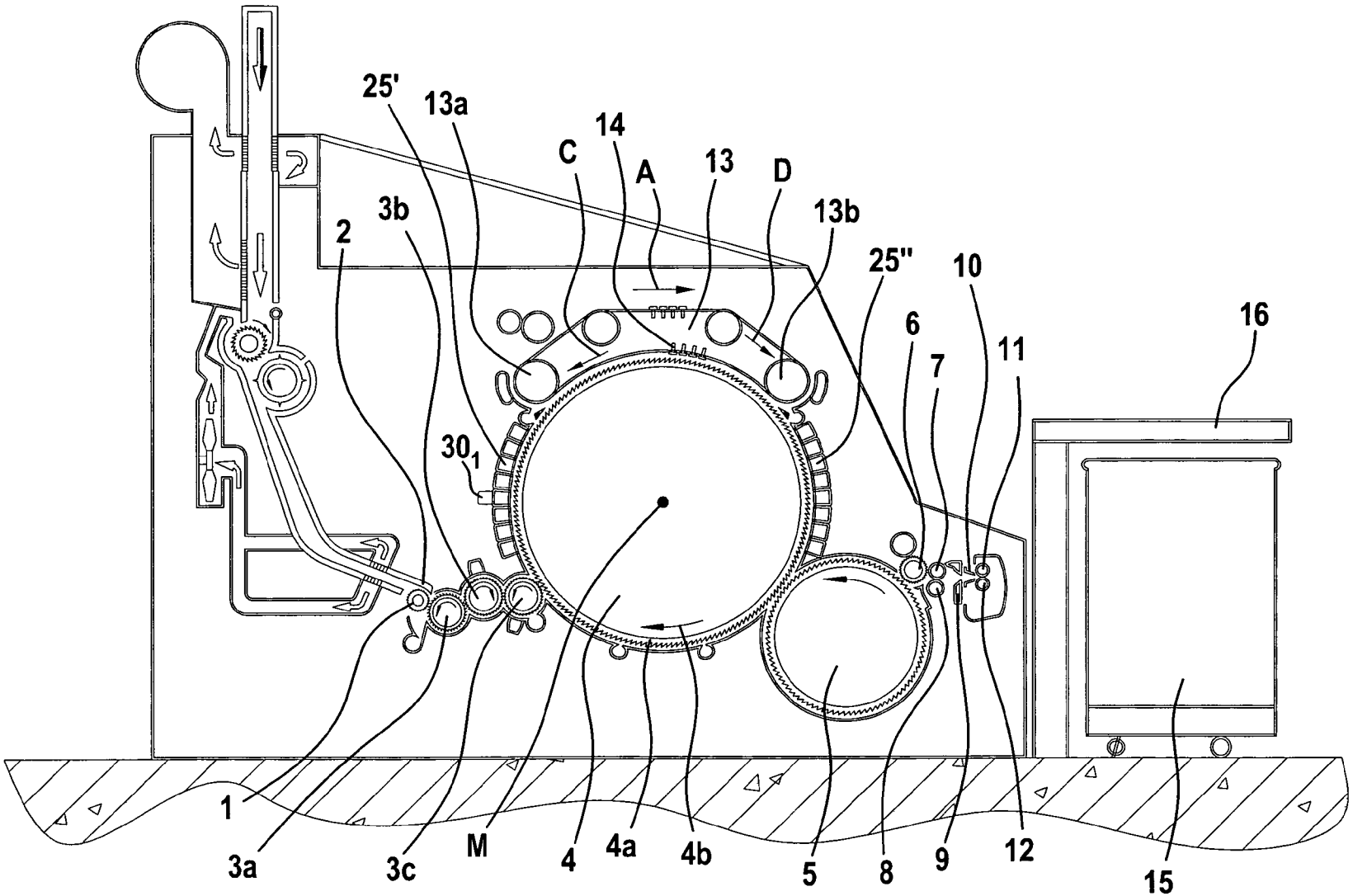
FIG. 1 is a diagrammatic side view of a flat card with which the apparatus according to the invention may be used.

With reference to FIG. 1, a flat card, for example a TC 03 flat card made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, delivery rollers 11, 12, revolving card top 13 having card top guide rollers 13*a*, 13*b* and flats 14, can 15 and can coiler 16. The directions of rotation of the rollers are indicated by curved arrows. Reference letter M denotes the centre (axis) of the cylinder 4 and reference letter A denotes the working direction. Reference 4*a* denotes the clothing and reference 4*b* denotes the direction of rotation of the high-speed cylinder 4. Reference letter C denotes the direction in which the revolving card top 13 revolves at the carding location and reference letter D denotes the return transport direction of the flats 14. In the pre-carding region—between the licker-in 3*c* and the back card top guide roller 13*a*—there are arranged a plurality of fixed carding elements 25' (see FIG. 3), and in the post-carding region—between the front card top guide roller 13*b* and the doffer 5—there are arranged a plurality of fixed carding elements 25" (see FIG. 3). A structure-borne sound sensor $\mathbf{30}_1$ is arranged at one of the fixed carding elements 25' in the pre-carding region.

Figure 2:
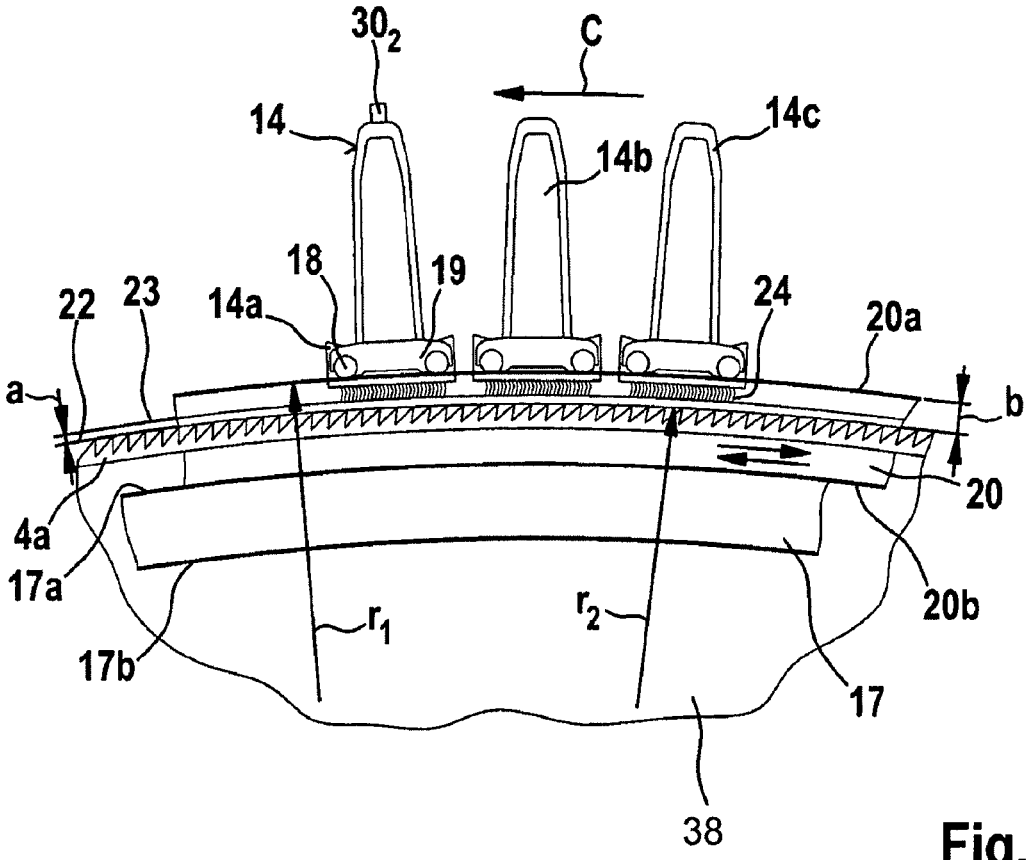
FIG. 2 shows flats of a revolving card top unit and part of the cylinder with a carding nip between the clothings of the revolving card top flats and the clothing of the cylinder.

FIG. 2 shows a portion of a revolving card top of a flat card of the kind shown in FIG. 1. A flexible bend 17 having several adjustment screws is fixed laterally to the frame of the machine on each side, using screws (not shown). The flexible bend 17 has a convex outer surface 17*a* and an underside 17*b*. On top of the flexible bend 17 there is a slideway 20, for example made of low-friction plastics material, which has a convex outer surface 20*a* and a concave inner surface 20*b*. The concave inner surface 20*b* rests on top of the convex outer surface 17*a*. The card flats 14, which are extruded from aluminium, have a carrier member 14*c* in the form of a hollow profiled member and, at each of their two ends, a card flat foot 14*a*, in which there are mounted in an axial direction two steel pins 18, which slide on the convex outer surface 20*a* of the slideway 20 in the direction of arrow C. The card flat clothing 24 (small wire hooks) is mounted on the underside of the card flat foot 14*a*. Reference numeral 23 denotes the circle of tips of the card flat clothings 24. On the outside of the carrier member 14*c* of one of the card flats 14 there is arranged a structure-borne sound sensor $\mathbf{30}_2$.

The cylinder 4 has on its circumference a cylinder clothing 4*a*, for example a sawtooth clothing. Reference numeral 22 denotes the circle of the tips of the cylinder clothing 4*a*. The spacing (carding nip) between the circle of tips 23 and the circle of tips 22 is denoted by reference letter a and is, for example, $^2/_{1000}$". The carding spacing of the flat card, that is to say of the cylinder 4 having the cylinder clothing 4*a* and of the card flats 14 having the card flat clothings 24, is set in practice. In order to reduce or avoid the risk of collisions, the carding nip between clothings located opposite one another is in practice set to be slightly greater, that is to say a certain safety margin is provided. However, a large carding nip results in undesirable nep formation in the carded sliver. Rather, an optimum, especially a narrow, size is desirable, as a result of which the proportion of neps in the carded sliver is substantially reduced. The spacing between the convex outer surface 20*a* and the circle of tips 22 is denoted by reference letter b. The radius of the convex outer surface 20*a* is denoted by reference letter $r_1$ and the constant radius of the circle of tips 22 is denoted by reference letter $r_2$. The radius $r_2$ intersects the centre point M (see FIG. 1) of the cylinder 4. Reference numeral 19 denotes a clamping element, which engages around the card flat pins 18 and which is connected to the drive belt (not shown) for the card flats 14.

Figure 3:
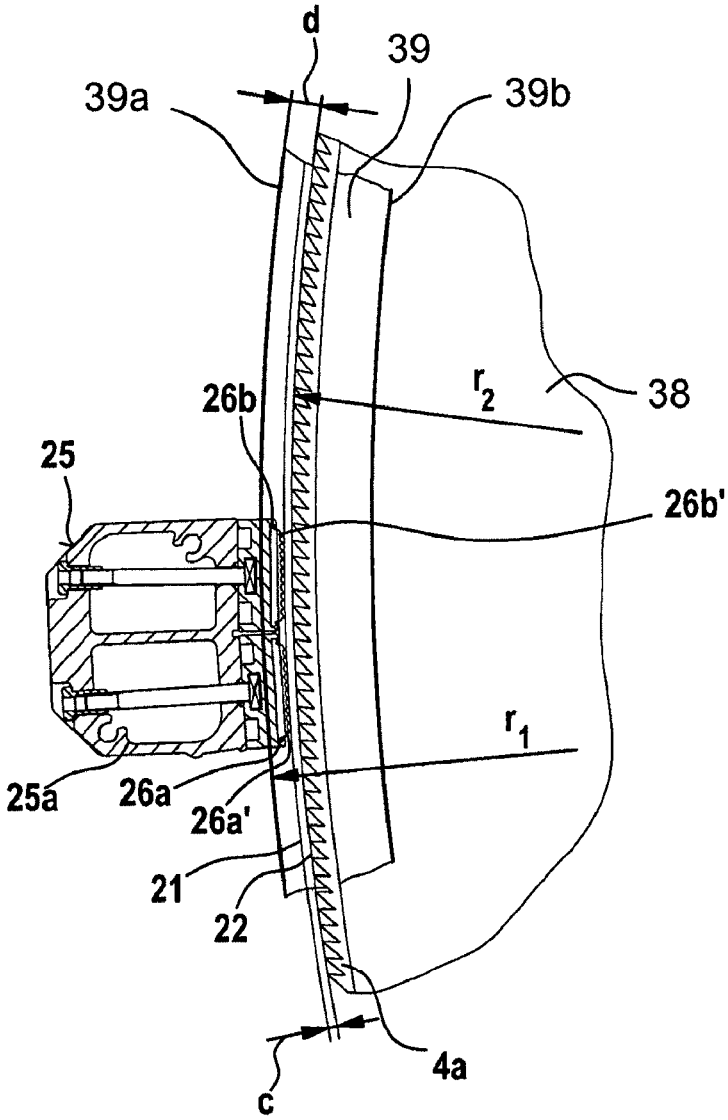
FIG. 3 shows, partly in section, a stationary carding segment and part of a side screen, with a spacing between the carding segment clothing and the cylinder clothing.
Figure 3:
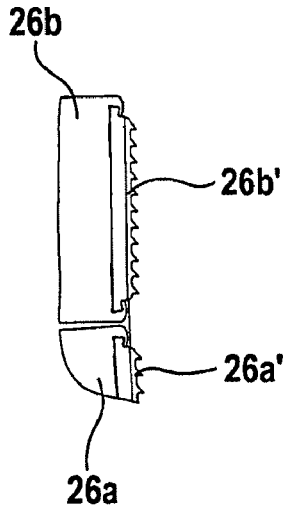

In FIG. 3, there is shown a stationary carding element, which may be used with a further embodiment of the invention. An approximately semi-circular, rigid side panel 38 is fixed laterally to the machine frame (not shown) on each side of the flat card, on the outside of which panel in the region of the periphery there is integrally cast in a concentric position a rigid arcuate supporting element 39, which has, as supporting surface, a convex outer surface 39*a* and an underside 39*b*. Stationary carding elements 25 have, at both their ends, mounting surfaces, which are mounted on the convex outer surface 39*a* of the mounting element. Fixed to the underneath surface of the carding element 25 are carding segments 26*a*, 26*b* having carding clothings 26*a*', 26*b*. Reference numeral 21 denotes the circle of tips of the clothings 26*a*', 26*b*. The cylinder 4 has, around its circumference, a cylinder clothing 4*a*, for example a saw-tooth clothing. Reference numeral 22 denotes the circle of tips of the cylinder clothing 4*a*. The spacing between the circle of tips 21 and the circle of tips 22 is indicated by the reference letter c and is, for example, 0.20 mm. Reference letter d denotes the spacing between the convex outer surface 39*a* and the circle of tips 22. Reference $r_1$ denotes the radius of the convex outer surface 39*a* and reference $r_2$ denotes the radius of the circle of tips 22. The radii $r_1$ and $r_2$ intersect in the centre M (see FIG. 1) of the cylinder 4. The carding element 25 according to FIG. 3 consists of a carrier 25*a* and two carding segments 26*a*, 26*b*, which are arranged one after the other in the direction of rotation (arrow 4*b*) of the cylinder 4, the clothings (26*a*', 26*b*') of the carding segments 26*a*, 26*b* and the clothing 4*a* of the cylinder 4 lying opposite one another. The spacing c between the clothings 26*a*', 26*b*' of the carding segments 26*a*, 26*b* and the cylinder clothing 4*a* is of great importance to the carding process and to the result of carding.

Figure 3A:
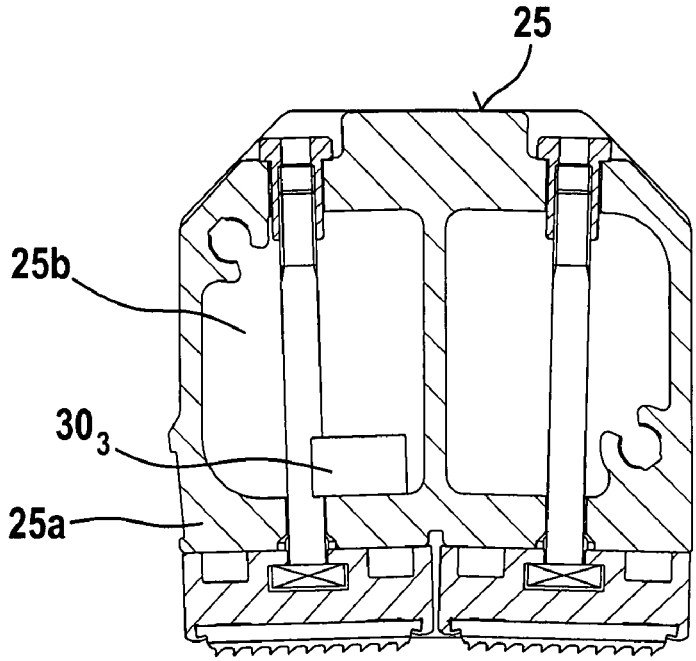
FIG. 3*a* is a section of a carding segment according to FIG. 3, with a first embodiment of the structure-borne sound sensor.
Figure 3B:
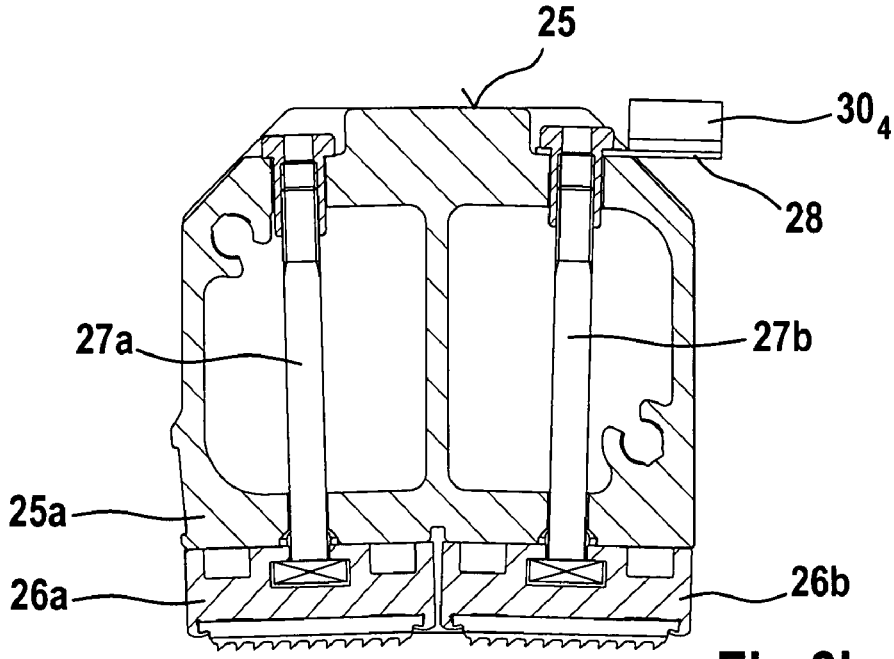
FIG. 3*b* is a section of a carding segment according to FIG. 3, with a further embodiment of the structure-borne sound sensor.

In the embodiment of FIG. 3*a*, a structure-borne sound sensor $\mathbf{30}_3$ is attached to an inside wall surface of a hollow space 25*b* in the carrier member 25*a*. In another embodiment shown in FIG. 3*b*, the carding segments 26*a* and 26*b* are attached to the carrier 25*a* by means of bolts 27*a* and 27*b*, respectively. One end region of a bracket 28 is also attached to the carrier 25*a* by means of the bolt 27*b*, there being attached to the other end region of the bracket 28 a structure-borne sound sensor $\mathbf{30}_4$.

In a further embodiment shown in FIG. 4, a structure-borne sound sensor is associated with a card flat of a revolving card top. FIG. 4 shows a section through a card flat 14, a structure-borne sound sensor $\mathbf{30}_5$ being attached in the internal space 14*b* of the hollow profiled member, on the card flat foot 14*a*.

In another embodiment, in FIG. 5, a stationary structure-borne sound sensor $\mathbf{30}_6$ is attached at one end of a structure-borne sound guide plate 29, the other end of which is in successive contact with the ends of the card flats 14', 14", 14"' slowly moved in direction c, in the course of which the structure-borne sound of the card flats 14', 14", 14"' is detected.

FIG. 6 shows schematically the flat card according to FIG. 1. The structure-borne sound sensor $\mathbf{30}_1$ is attached to the fixed carding element 25' and is connected to an electrical control and regulation device 31, for example a microcomputer with a microprocessor. The electrical control and regulation device 31 comprises a filter device (not shown) and an evaluation device (not shown). The filter device, for example a high-pass filter, filters out low-frequency vibrations. The evaluation device, which comprises, for example, a frequency analysis function, evaluates the signals of the structure-borne sound sensor $\mathbf{30}_1$. From the evaluated signals there are produced, in the control and regulation device 31, actuation signals for the electric drive motor 32, for example a speed-of-rotation-controlled motor, for driving the cylinder 4. Also connected to the control and regulation device 31 is a display device 33, which shows the frequency response, for example, in graphical form.

The measurement values of the carding intensity determination are evaluated with respect to:

Mean standard deviation coefficient of variation, CV value number of peaks with respect to a threshold value the frequency distribution of the voltage signals, and characteristic variables thereof etc. and this information is used in the context of a closed control circuit for controlling actuating members of the machine.

The sensitivity with which a structure-borne sound sensor $\mathbf{30}_1$ to $\mathbf{30}_6$ registers component vibrations, produced by fibre contact, in the audible range is given in V/N (volts per newton).

Figure 7A:
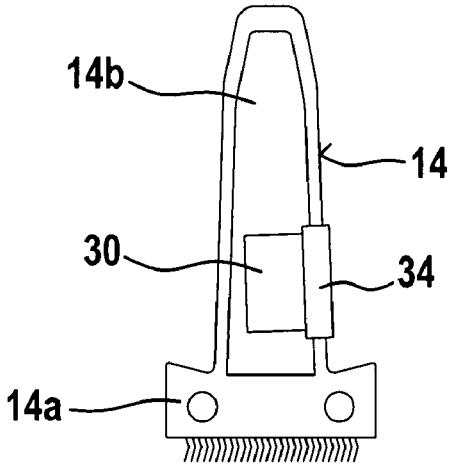
FIGS. 7*a*, 7*b* are a side view (FIG. 7*a*) and a front view (FIG. 7*b*) of a flat including an embodiment having a clasp and a structure-borne sound sensor internally arranged.
Figure 7B:
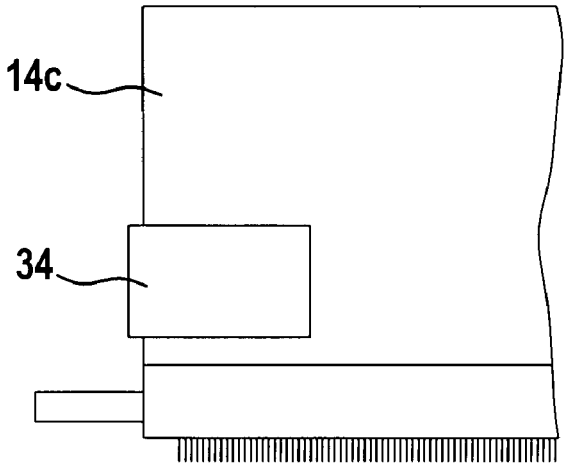

In the embodiment of FIGS. 7*a*, 7*b*, a structure-borne sound sensor 30 is associated with, for example adhesively bonded, screwed or magnetically connected to, a clasp 34. This clasp is associated with any desired card flat 14 by means of a force-based and/or shape-based connection. The structure-borne sound consequently passes from the revolving card top, by way of the clasp 34, into the structure-borne sound sensor 30, where it is converted into an electrical signal. Such attachment of the structure-borne sound sensor provides maximum flexibility with regard to selection of the card flat 14 and the card flat clothing and also of the flat card, because the clasp can be placed on any desired card flat. It also allows the sensor to be attached permanently to a card flat, that is to say the sensor runs around permanently in the card top unit, attached to or on a particular card flat 14. The clasp has two resilient arms, both of which bear a contact element at the free end, one contact-element-bearing arm being associated with an inner wall and the other contact-element-bearing arm being associated with an outer wall of the carrier member 14*c*. The structure-borne sound sensor 30 is located on an arm in the hollow internal space 14*b*.

Figure 8:
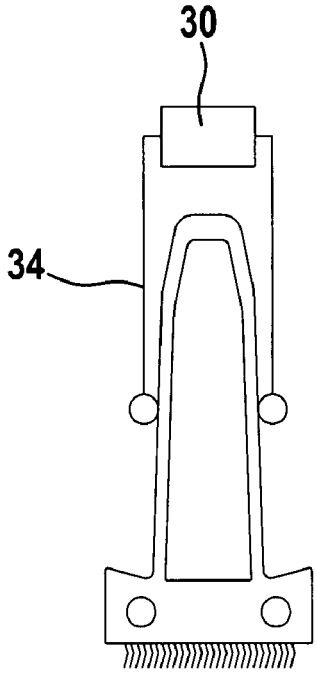
FIG. 8 is a side view of a card flat including an embodiment having a clasp and a structure-borne sound sensor externally arranged.

In a further embodiment shown in FIG. 8, one contact-element-bearing arm of a clasp is associated with one outer wall and the other contact-element-bearing arm is associated with another outer wall of a carrier member 14*c* of a card flat. The structure-borne sound sensor 30 is located outside the carrier member 14*c*.

Figure 9:
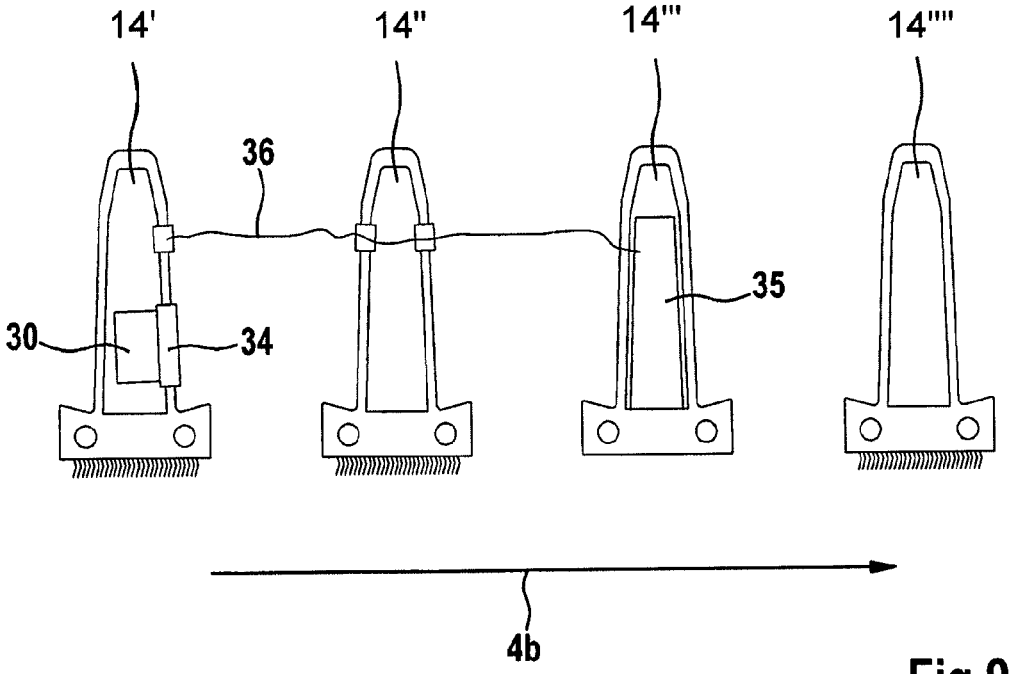
FIG. 9 is a side view of a plurality of flats, wherein a clasp with a structure-borne sound sensor is associated with a carding flat, and an associated electronics unit is associated with a non-carding flat.

In yet another embodiment shown in FIG. 9, the functions of measurement data collection and of evaluation can be split between two card flats 14' and 14"', respectively ("measurement flat duo"). This measurement flat duo consists of two flats. With a first, carding flat 14' there is associated the structure-borne sound sensor 30 having a clasp 34, and with a further flat 14"', which has no clothing, there are associated the necessary electronic components 35, that is to say they are on-board. The flat 14' having the structure-borne sound sensor 30 is positioned first, seen in the direction contrary to the running direction 46 of the drum 4, and the flat 14"' having the electronics 35 (without a clothing) follows after that flat. The two flats are connected to one another by measurement data cable 36. Reference letter 4*b* denotes the running direction of the opposed carding surface whilst the flats 14' to 14"" move in the opposite direction to the arrow 4*b*.

This measurement flat duo can be used in any desired flat card. It is possible to replace one of the flats of the flat card with the flat having the electronics units and to attach the clasp with the structure-borne sound sensor to a card flat positioned in advance thereof. As a result, measurement of the carding intensity is possible under operating conditions that are as realistic as possible. The measurement equipment is no larger and no heavier than an instrument case accommodating the flat with electronics units and the structure-borne sound sensor with clasp.

Figure 10:
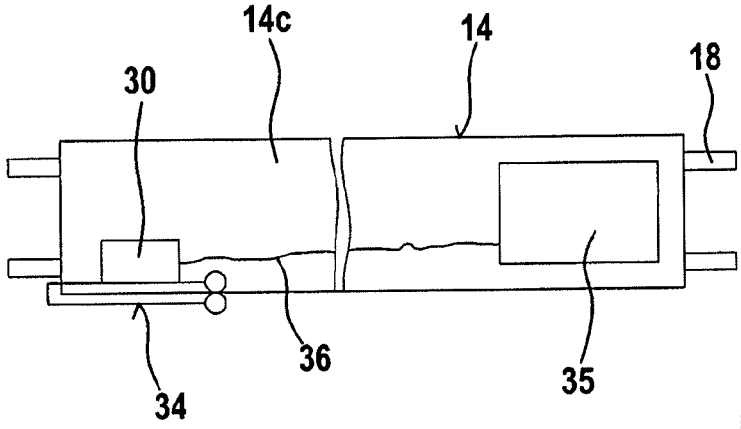
FIG. 10 is a top sectional view of a card flat, wherein both a clasp with a sensor and also the associated electronics unit are associated with the same card flat.

FIG. 10 shows another embodiment in which both the clasp 34 with the structure-borne sound sensor 30 and also the associated electrical unit 35 are associated with the same card flat 14. The structure-borne sound sensor 30 and the electrical unit 35 are connected to one another by means of a measurement data cable 36. The structure-borne sound sensor 30 and the electrical unit 35 are located in the hollow internal space 14*b* of the carrier member.

Although the foregoing invention has been described in detail by way of illustration and example for purposes of understanding, it will be obvious that changes and modifications may be practiced within the scope of the appended claims.

What is claimed is:

1. An apparatus at a spinning preparation machine having a clothed roller and at least one clothed component opposed to said roller, comprising: a sensor device which is locatable on a said opposed clothed component, the sensor device comprising a piezoelectric sensor arranged to detect structure-borne sound; and an evaluation device arranged to determine from the structure-borne sound the intensity of contact between fibres and the clothing of said opposed clothed component.

2. An apparatus according to claim 1, in which the evaluation device is in communication with a display device for displaying data relating to the detected structure-borne sound; or a switching device for adjusting a machine setting in dependence upon the detected structure-borne sound.

3. An apparatus according to claim 1, in which the sensitivity of the structure-borne sound sensor is about 10 V/N to about 50 V/N.

4. An apparatus according to claim 1, in which the structure-borne sound sensor is capable of detecting vibrations in the range from about 2.5 kHz to about 12.5 kHz and/or the evaluation device is capable of filtering out frequencies outside the range from about 2.5 kHz to about 12.5 kHz.

5. An apparatus according to claim 1, in which the structure-borne sound sensor is arranged directly on the rear side of the clothing of the clothed component.

6. An apparatus according to claim 1, in which the structure-borne sound sensor is fixed at or in the vicinity of the middle of the machine width.

7. An apparatus according to claim 1, in which the structure-borne sound sensor is fixed in a fixed carding segment.

8. An apparatus according to claim 1, in which the structure-borne sound sensor is fixed to the component by means of an adhesive; by means of magnetic force; by means of a screw connection; or by means of a shape-based connection.

9. An apparatus according to claim 1, in which a structure-borne sound conductor is provided between a clothing support and an adapter plate for receiving the sensor device.

10. An apparatus according to claim 1, in which the structure-borne sound sensor is so arranged that it can be selectively associated with different clothing-strip-carrying components by means of a rapid closure device.

11. An apparatus according to claim 1, in which the structure-borne sound sensor signals are evaluated by means of statistical evaluation methods, in which the variables standard deviation and CV value are determined, and represent a measure of the fibre unraveling.

12. An apparatus according to claim 1, in which, on the basis of the carding intensity information at each of two or more carding components, the clothing wear can be assessed and the setting checked.

13. An apparatus according to claim 1, in which the cumulative carding intensity of the machine is compared with a quality statement for the machine.

14. An apparatus according to claim 1, in which the structure-borne sound sensor is in the form of a portable unit which can be used on any spinning preparation machine or on any clothed component within a said machine.

15. An apparatus according to claim 1, in which the structure-borne sound sensor signal is usable to grade the carding elements by comparing the determined carding coefficients of all the carding elements with specifications relating to desirable grading of the carding intensity.

16. An apparatus according to claim 1, in which the structure-borne sound sensor is associated with a revolving card top of a flat card, is fixed in or on the revolving card top and revolves with it.

17. An apparatus according to claim 16, in which a first flat, having a clothing, carries the structure-borne sound sensor and a second flat, not having a clothing, having on-board electronics units, runs behind the first flat.

18. An apparatus according to claim 16, in which the sensor is associated with a holding element in contact with and touching at least two different wall surfaces of a carrier member of a card flat of the revolving card top.

19. An apparatus according to claim 1, in which the structure-borne sound sensor is fixed in a stationary position on a track along which card flats of a revolving card top travel.

20. An apparatus at a spinning preparation machine having a clothed roller and at least one guide element opposed to said roller, comprising: a sensor device which is locatable on a said opposed guide element, the sensor device comprising a piezoelectric sensor arranged to detect structure-borne sound; and an evaluation device arranged to determine from the structure-borne sound the intensity of contact between fibres and the said opposed guide element.

* * * * *